United States Patent [19]

Keller et al.

[11] Patent Number: 4,577,802

[45] Date of Patent: Mar. 25, 1986

[54] METHOD AND SYSTEM FOR FURROW IRRIGATION

[75] Inventors: Jack Keller, Logan; Glen E. Stringham, Millville, both of Utah

[73] Assignee: Utah State University Foundation, Logan, Utah

[21] Appl. No.: 763,314

[22] Filed: Aug. 6, 1985

Related U.S. Application Data

[63] Continuation of Ser. No. 651,048, Sep. 14, 1984, abandoned, which is a continuation of Ser. No. 61,693, Jul. 30, 1979, abandoned.

[51] Int. Cl.[4] ..... B05B 17/04; A01G 25/16; E02B 13/00

[52] U.S. Cl. ..... 239/11; 239/66; 239/69; 137/624.18; 405/36

[58] Field of Search ..... 239/1, 11, 63, 66, 67, 239/69, 70, 200, 207, 266; 405/36, 37; 134/624.11, 614.18, 624.2

[56] References Cited

U.S. PATENT DOCUMENTS

| | | | |
|---|---|---|---|
| 3,140,720 | 7/1964 | Griswold | 239/70 X |
| 3,217,188 | 11/1965 | Bauer | 307/141.4 |
| 3,402,890 | 9/1968 | Heitzman | 239/66 |
| 3,440,434 | 4/1969 | Yates et al. | 307/41 |
| 3,493,176 | 2/1970 | Kinkead | 239/11 |
| 3,578,245 | 5/1971 | Brock | 239/66 |
| 3,599,867 | 8/1971 | Griswold et al. | 239/70 |
| 3,741,246 | 6/1973 | Braytenbah | 137/624.1 |
| 3,797,740 | 3/1974 | Kah, Jr. | 239/11 |
| 3,797,741 | 1/1974 | Spencer | 239/11 |
| 3,951,339 | 4/1976 | DuFresne | 239/66 |
| 3,969,722 | 7/1976 | Danco et al. | 340/172.5 |
| 3,975,622 | 8/1976 | Horn et al. | 235/151.1 |
| 4,006,464 | 2/1977 | Landell | 340/172.5 |
| 4,015,366 | 4/1977 | Hall, III | 47/1 R |
| 4,085,769 | 4/1978 | van Haaften | 137/119 |
| 4,176,395 | 11/1979 | Evelyn-Veere et al. | 364/420 |

FOREIGN PATENT DOCUMENTS

| | | | |
|---|---|---|---|
| 973273 | 8/1975 | Canada | 342/18 |
| 348102 | 1/1922 | Fed. Rep. of Germany | 405/36 |
| 599769 | 4/1978 | U.S.S.R. | 239/11 |
| 681151 | 8/1979 | U.S.S.R. | 405/36 |

*Primary Examiner*—Andres Kashnikow
*Assistant Examiner*—Mary Beth O. Jones
*Attorney, Agent, or Firm*—Workman, Nydegger & Jensen

[57] ABSTRACT

The present invention relates to methods and apparatus for distributing irrigation water relatively evenly along a furrow. Irrigation water is first advanced down the furrow during an advance phase so as to form a wetted surface at the bottom of the furrow. In one preferred embodiment, the advance phase comprises a cyclic on/off procedure to cyclically advance the wetted surface towards the bottom end of the furrow. After the advance phase has been completed, irrigation water is supplied to the head end of the furrow during an infiltration phase which employs a cyclic on/off procedure. The on/off cycles of the infiltration phase are substantially shorter than the on/off cycles of the advance phase, and are repeated a predetermined number of times in order to supply a predetermined amount of irrigation water to the furrow. Apparatus comprising control means for administering such furrow irrigation methods are also disclosed.

15 Claims, 4 Drawing Figures

METHOD AND SYSTEM FOR FURROW IRRIGATION

This application is a continuation of U.S. application Ser. No. 651,048, filed Sept. 14, 1984, for "Method and System for Furrow Irrigation", which is a continuation application of Ser. No. 061,693 filed July 30, 1979, both now abandoned.

BACKGROUND OF THE INVENTION

1. Field

The invention relates to controlled irrigation of agricultural fields, and, in particular, to a system for automatic furrow irrigation.

2. State of the Art

In furrow irrigation of agricultural fields, the furrows must transport water from the top or head ends thereof to the mutually respective bottom ends thereof and, in addition, provide the infiltration medium for the water to enter the soil. In accomplishing the infiltration function, water must be in contact along the full length of the furrow for a sufficient time to allow the required infiltration of water into the soil. If small streams of water are used, the required volume of water can be applied, but most of the water enters the soil near the head ends of the furrows, with little water infiltrating the soil at the bottom ends of the furrows. On the other hand, when a large stream is applied to the head ends of the furrows, the water advances rapidly to the bottom ends and must be allowed to runoff for a sufficient time to permit the required infiltration along the length of the furrow. The run-off is often wastefully lost.

Cutback methods have been proposed in which a large stream of water is applied to the head ends of the furrows during the initial stage of the irrigation wherein water is advanced rapidly to the bottom end of the furrows to reduce deep percolation at the head end of the furrows. When the water has advanced to the bottom ends of the furrows, the size of the stream of water introduced at the head ends is reduced to minimize the amount of run-off which occurs during the remaining infiltration stage of the irrigation. Heretobefore, the cutback in the flow of water to the head ends of the furrows has been achieved by providing a constant flow of water at a reduced rate of flow to the head ends of the furrows during the infiltration stage of the irrigation. Reducing the flow rate at the head ends of the furrows still tends to result in a shallower penetration of water at the bottom ends of the furrows than at the head ends.

3. Objectives

Principal objectives of the present invention are to provide a method and apparatus wherein effective cutback in the flow of water to the furrows during irrigation is achieved by providing intermittent flow of water to the head ends of the furrows instead of controlling the flow rate of a continuously flowing stream.

SUMMARY OF THE INVENTION

The above objectives are achieved by providing a water supply source along the head ends of the furrows and remotely controlled, on-off valves at the head ends of the furrows. The valves are automatically controlled by appropriate control means to achieve a desired flow of water during both the initial advance stage of the irrigation and during the subsequent infiltration stage of the irrigation.

In one preferred embodiment, at the beginning of the irrigation, the valves are opened, and the valves remain open continuously during the initial or advance stage of the irrigation. The duration of the initial stage of the irrigation is sufficient for water to rapidly advance from the head ends to the mutually respective bottom ends of the furrows. Subsequently, the automatic control means terminates the initial stage and initiates a second or infiltration stage in which a predetermined incremental cutback in the flow of water is achieved by controlled intermittent disruption of the flow of water to each furrow. During the infiltration stage the valves at the head ends of the furrows are automatically operated in repeated on-off cycles, wherein each cycle comprises a first set time duration in which the respective valve is opened followed by a second set time duration in which the respective valve is closed.

In another preferred embodiment, intermittent flow of water to the area being irrigated is used in the initial or advance stage of irrigation, as well as in the second or infiltration stage.

Additional objects and features of the present invention will become apparent from the following detailed description of preferred embodiments taken in conjunction with the accompanying drawing.

THE DRAWING

A preferred embodiment of apparatus and system of the present invention representing the best mode presently contemplated of carrying out the invention is illustrated in the accompanying drawing, in which.

DETAILED DESCRIPTION OF THE PREFERRED EMBODIMENTS

Figure 1:
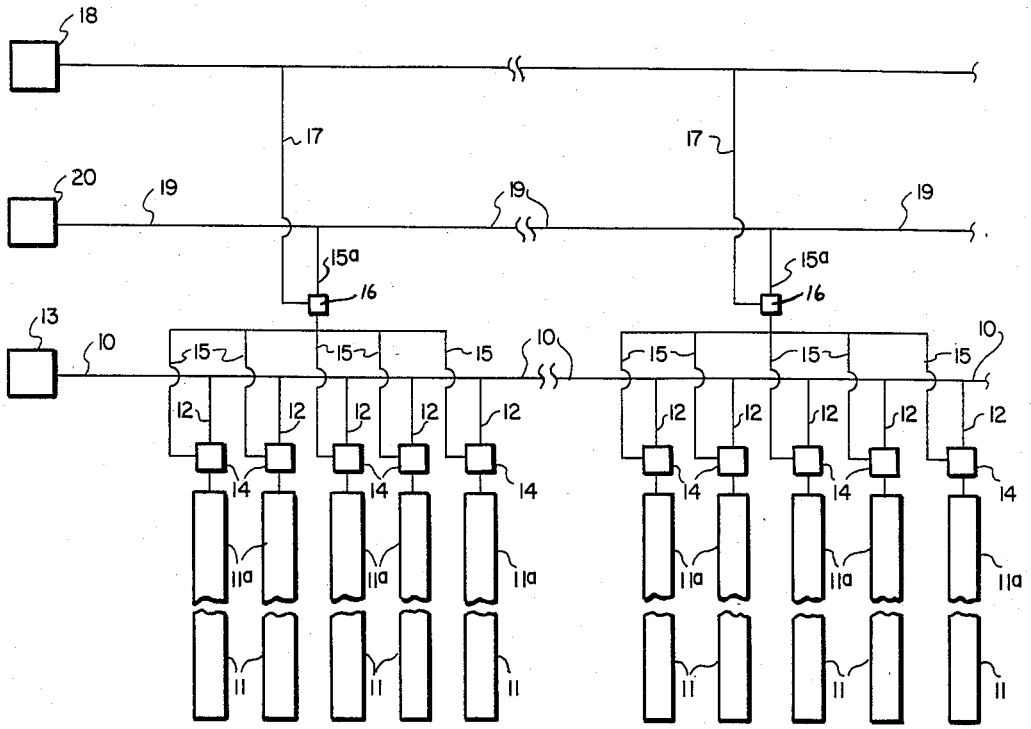
FIG. 1 is a general schematic of a system of furrow row irrigation in accordance with the invention.

Referring to FIG. 1 of the drawing, there is shown a system for automated furrow irrigation in accordance with the invention. The system comprises a water conveying conduit 10 adapted for use as a water header to supply irrigation water to the respective head ends 11*a* of a plurality of furrows 11 in the field which is to be irrigated. The conduit 10 receives water from a source thereof 13 which can be from a surface ditch or a suitable pipe line. The conduit 10 is a gated pipe, advantageously made of aluminum or plastic. The gates are spaced along the conduit 10 in the near vicinity of the head ends 11*a* of mutually respective furrows 11. The gates advantageously comprise relatively short sections 12 of conduit which are in fluid flow communication at mutually respective ends with the header conduit 10 (see FIGS. 1 and 2). The other mutually respective ends of the gate sections 12 are adapted to be quick coupled to respective water control valves 14.

Figure 4:
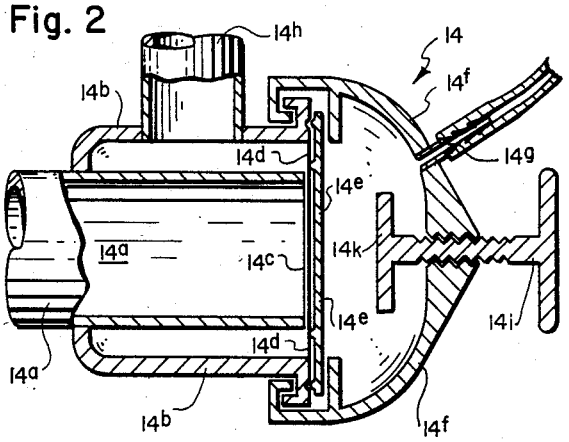
FIG. 4 is a cross-sectional view of an air-operated water valve used in the system of FIG.1.

The water control valves 14 are fluid operated, and each valve 14 is adapted to control the flow of water from the gate conduits 12 to a mutually respective furrow 11 in the field which is to be irrigated. A preferred, air-operated, water control valve is shown in FIG. 4 and will be more fully described hereinafter. Broadly, the water control valves 14 can be of any remotely controlled nature, capable of turning the flow of water into the respective furrows on and off in accordance with a preset control logic administered by a master control means. As illustrated in FIG. 1, the valves 14 are fluid operated, and a header conduit 19 of pressurized fluid extends from a source of pressurized fluid 20 to and along the water conduit 10. Each of the fluid controlled, water control valves 14 are connected by individual feeder conduits 15, respectively, to a plurality of remote controlled valves 16. The valves 16 are, in turn, connected by conduits 15*a* to the header conduit 15 of pressurized fluid. As shown, the conduits 15 are advantageously ganged into sets comprising two or more individual conduits 15. Each ganged set of conduits 15 is connected to a respective remote controlled valve 16. If desired, an individual remote controlled valve and conduit 15*a* can be associated with each individual feeder conduit 15; however, a capital investment savings in valve costs is achieved by ganging the conduits 15 into sets as described above. The remote controlled valves 16 are preferably solenoid activated, with the solenoid being connected by electric cables 17 to a master control unit 18. When commanded by the master control unit 18, the respective solenoid control valves 16 are adapted to close and open, thus controlling the delivery of pressurized fluid to the fluid operated valves 14.

Figure 3:
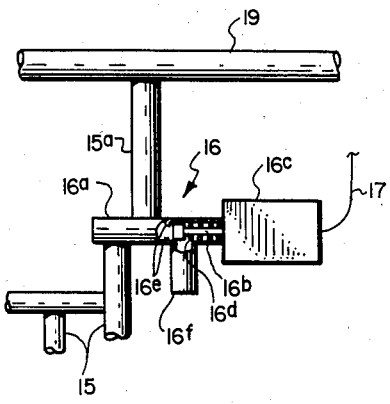
FIG. 3 is a fragmentary plan view of a solenoid operated air valve showing a portion of the valve broken away.

In a preferred embodiment of the invention, the pressurized fluid is compressed air with the source 20 of pressurized fluid being an air compressor. A control valve 16 which is adapted to operate with compressed air is shown in FIG. 3. The valve 16 comprises an elongate hollow cylindrical chamber 16*a* coupled into the air supply conduit 15. A plunger 16*b* extends from the solenoid 16*c* into the cylindrical chamber 16*a* and is biased by spring 16*d* into contact with a valve seat 16*e* within the cylindrical chamber 16*a*. When the plunger 16*b* seats against the valve seat 16*e*, flow communication is established between the legs of conduit 15 between which the valve 16 is coupled. Thus, air pressure is transmitted from the air supply line 19 through feeder conduits 15 to the air controlled, water valves 14. When the solenoid 16*c* is energized through the electrical cable 17, the plunger 16*b* is withdrawn from the valve seat 16*e* against the action of the spring 16*d*. With the plunger 16*b* withdrawn away from the valve seat 16*e*, flow communication is established from the chamber 16*a* through an exhaust vent 16*f* to the atmosphere. Venting the compressed air through the exhaust vent reduces the pressure transmitted to the water valves 14.

Figure 2:
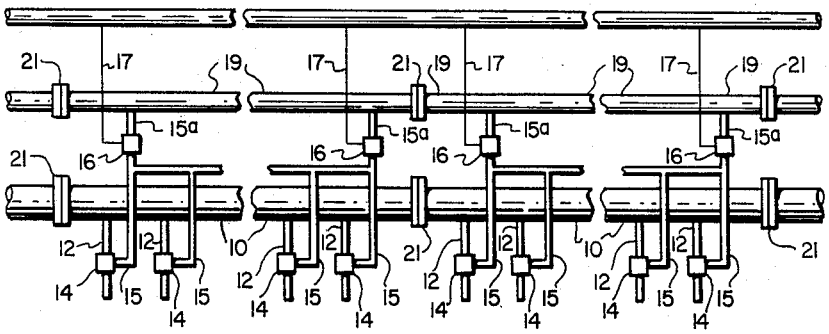
FIG. 2 is a fragmentary schematic of a portion of the system of FIG. 1 showing interconnecting lengths of water supply conduit and air lines.

As shown in FIG. 2, the water conveying conduit 10 and the fluid header conduit 19 each preferably comprise a plurality of lengths or pieces of respective conduit which are adapted to be fitted together in end-to-end relationship using coupling means 21 so that successive lengths of the water conveying conduit 10 and fluid header conduit 19 can be quickly coupled together, respectively, to make the total distributing line as long as desired. Conventional, commercially available quick coupling units are used to couple the respective conduits together. The electrical cables 17 from each of the remote controlled solenoid valves 16 are advantageously combined in a composite cable which runs side-by-side of the water conduit 10 and fluid conduit 19. The electrical cables 17 are connected to the master control unit 18 which is adapted to periodically supply and terminate electrical current to the solenoids on the respective remote controlled valves at predetermined intervals. The fluid header conduit 19 and multiple electrical conductor cable are preferably supported by a plurality of support bridges mounted on the respective gate sections 12, valves 14, or along the water conduit 10.

A preferred embodiment of a fluid-controlled water valve 14 is shown in FIG. 4. The valve is advantageously designed to operate using compressed air as the fluid control medium. The valve comprises a hollow, substantially cylindrical, water receiving chamber 14*a* which is adapted to receive water at one end thereof from the water source, such as the gate sections 12 of the water conveying conduit 10 and to discharge water from the other end thereof. A housing 14*b* is positioned coaxially around at least the discharge end portion of the water receiving chamber 14, with the housing 14*b* having an open end 14*d* substantially adjacent to the discharge end 14*c* of the water receiving chamber 14*a*.

A diaphragm 14*e* is positioned across the otherwise open end 14*d* of the housing 14*b*. The diaphragm 14*e* is held in place against the open end 14*d* of the housing 14*b* by an end cap 14*f* which is adapted to be removably attached to the open end 14*d* of the housing 14*b* and to hold the diaphragm 14*e* in sealed engagement with the open end 14*d* of the housing 14*b*. The end cap 14*f* also forms a hollow, fluid-receiving chamber on the side of the diaphragm 14*e* opposite the housing 14*b*. Preferably, the open end of the housing 14*d* and the end cap 14*f* are adapted to be quickly and easily coupled to each other by conventional twist-lock systems such as a bayonet and rim system as shown in FIG. 4.

A port 14*g* (shown as a nipple) is provided in the end cap 14*f*, with the port 14*g* being adapted to be connected in flow communication to a respective supply line 15 of pressurized fluid, such as compressed air. Advantageously, the supply line 15 is made of a reinforced elastomeric material and is adapted to fit tightly over the nipple comprising the port 14*g*. Clamp means can be used if so desired to securely affix the end of the supply line 15 to the nipple.

When a pressurized fluid, such as compressed air, is supplied from supply line 15 to the fluid-receiving chamber through the port 14*g*, the diaphragm 14*e* is maintained in tight, sealing engagement with the open end 14*c* of the water-receiving chamber 14*a*, thereby preventing discharge of water therefrom. When the pressure is released from the fluid-receiving chamber through the port 14*g*, the water in the water-receiving chamber deflects the diaphragm and is, thus, allowed to discharge through the open discharge end 14*c*. The water flows through the space between the housing 14*b* and receiving chamber 14*a* to an opening 14*h* in the housing 14*b*, whereupon the water is delivered to a respective furrow which is to be irrigated.

Means are preferably provided in the end cap 14*f* for manually adjusting the maximum flow rate of water from the discharge end 14*c* of the water-receiving chamber 14*a* when the pressure of the fluid supplied to the fluid-receiving chamber is reduced. As illustrated in FIG. 4, a threaded opening is provided in the end cap 14*f* opposite the diaphragm 14*e*. Screw means 14*i* is received in the threaded opening so that the inwardly extending end of the screw 14*i* can be advanced toward and retracted away from the diaphragm 14*e* to thereby adjust the maximum deflection of the diaphragm 14*e*. Advantageously, the end of screw 14*i* which is positioned within the fluid-receiving chamber is provided with a substantially flat, disc element 14*k* which is adapted to make broad contact with the diaphragm 14*e*.

A method of furrow irrigation using the apparatus as above described comprises providing a water supply along the head ends of the furrows. The water is supplied through the water conveying conduit 10. A valved outlet is provided from the water conduit 10 for each furrow, so that when the valved outlet is open, water flows from the conduit 10 to the respective furrows. The valved outlet as illustrated comprises the gate sections 12 and associated valves 14. The respective valves 14 are operated in repeated on-off cycles, with each of the repeated on-off cycles comprising a first set time duration in which the respective valve is opened followed by a second set time duration in which the respective valve is closed.

The master control unit 18 comprises a programmable controller which automatically controls the opening and closing of all the valves 14 using preset logic. As illustrated, the master control unit energizes the solenoids 16 which are associated with the valves which are to be opened. As explained hereinabove, when the solenoid associated with the respective valve which is to be opened is energized, the compressed air in the supply line 15 is vented to atmosphere and the air pressure in the fluid-receiving chamber formed by the end cap 14*f* of the valve 14 drops to a value approaching atmospheric. The water pressure in the water-receiving chamber 14*a* deflects the diaphragm 14*e* so that water can flow from the valve 14 to the head end of the respective furrow. When the flow of water to that furrow is to terminate, the master control unit 18 de-energizes the solenoid, and the air pressure in the supply line 15 and fluid-receiving chamber increases, thereby closing the diaphragm 14*c* against the open end 14*d* of the water-receiving chamber 14*a*.

One preferred method of furrow irrigation in accordance with the invention comprises an initial stage wherein all of the valves 14 associated with the furrows which are to be irrigated are simultaneously opened for a time sufficient to allow water to run from the head ends of the furrows to the mutually corresponding bottom ends of the furrows. Following the initial stage of simultaneous water flow to all the furrows, the valves at the head ends of the furrows are then operated in the repeated on-off cycles for the duration of the irrigation. The number of valves which are on at any one time during the cycling portion of the irrigation, as well as the duration of the on and off times can be preset at any desired values.

Advantageously, the number of valves 14 in the system is divided into two sets, thus dividing the furrows which are to be irrigated into the same two sets. Preferably, substantially equal number of valves are included in each set. The valves in the respective sets are opened and closed simultaneously, with the valves in the first set being open when the valves in the second set are closed and vice-versa. In each cycle, the valves are left open for a time duration sufficient for water to run from the head ends of the furrows to the mutually corresponding bottom ends. In subsequent cycles, the time needed for water to advance from the head ends to the bottom ends of the furrows decreases. Accordingly, it is a feature of the present invention to program the master control unit to automatically and progressively increase the frequency of the on-off cycles as the irrigation progresses. For example, the first cycle may be set for a duration of, say, 20 minutes (the first set of valves being open for the first 10 minutes of the cycle and then closed for the last ten minutes, and the second set of valves being closed for the first 10 minutes of the cycle and then opened for the last ten minutes). The duration of the second and subsequent cycles are progressively decreased. The second cycle may have a duration of 18 minutes, the third cycle 16 minutes, etc.

When the valves 14 are divided into two substantially equal sets, the percentage cutbacks in water during the the stage of the irrigation wherein the valves in the two sets are alternately turned off and on is 50%, i.e., total flow of water per increment of time is 50% of the total flow if all valves were open continuously. Various other percentages of cutback can be achieved by varying the duration of the on and off portions of each cycle. For example, if all the valves are operated as one set, i.e., all the valves are simultaneously opened and closed, the percentage cutback can be controlled by varying the ratio of duration of the open and closed portions of the operating cycle. For a 33% cutback, the time duration in which the valves are open is twice the time duration in which the valves are closed.

To achieve a more uniform draw of irrigation water from the source thereof, the valves 14 are divided into sets, such as the two equal set arrangement as described hereinbefore. For a system utilizing 33 or 66 percent cutback, the valves 14 are divided into three sets, with substantially equal number of valves in each set. For 33% cutback, the valves are operated in repeating cycles wherein each cycle comprises three stages. In the first stage, the first and second sets of valves are open and the third set of valves is closed. In the second stage, the first and third sets of valves are open and the second set of valves is closed. In the third stage, the second and third sets of valves are opened and the first set of valves is closed. The three stages have equal time duration per stage. For 66% cutback the valves are again operated in repeating cycles, with each cycle again comprising three stages of equal time duration. In the first stage, the first set of valves is open and the other two sets of valves are closed. In the second stage, the second set of valves are opened and the other two sets of valves are closed. In the third stage, the third set of valves are opened and the other two sets of valves are closed.

By dividing the valves into 4 sets, with substantially equal number of valves in each set, a percentage cutback of 25 or 75 can be achieved while drawing a substantially continuous amount of water from the source thereof. For 25% cutback, the valves are operated in repeating cycles, with each cycle comprising 4 stages having equal time duration per stage. In the first stage, the first, second, and third sets of valves are opened and the fourth set of valves is closed. In the second stage, the first, second, and fourth sets of valves are opened, and the third set of valves is closed. In the third stage, the first, third, and fourth sets of valves are opened, and the second set of valves is closed. In the fourth stage, the second, third, and fourth sets of valves are opened, and the first set of valves is closed. For 75% cutback the four sets of valves are operated in repeating cycles, with each cycle again comprising four stages. However, in each stage only one set of valves is opened and the other three sets of valves are closed. In the first stage, the first set of valves are opened, in the second stage, the second set of valves are opened, and so on through the four stages.

In another embodiment of the invention, intermittent flow of water to individual furrows is used in the initial or advance stage of the irrigation as well as in the second or infiltration stage. Cycling of the water supply to a furrow on and off in many instances advantageously improves the speed with which the water advances down the furrow for a given average furrow flow rate. The on-off cycle time during the advance stage is relatively long. For example, the cycle time could be within the range of one minute on and one minute off to ten minutes or more on and ten minutes or more off. Once the water has reached the end of the furrows, the infiltration stage is initiated and the frequency of the on-off cycles is progressively increased until the cycle comprises only a few seconds on and a few seconds off. Two sets of furrows could be used, with the flow of water alternating between the sets of furrows. It is also possible to use additional sets of furrows, such as three or four, wherein the flow of water flows only to one set of furrows at a time and alternates between the sets. With the three sets of furrows, each cycle would have an off time which has a duration twice that of the duration of the on time. With four sets, the off time would have a duration three times that of the duration of the on time.

It is to be understood that the present disclosure, including the detailed description of preferred embodiments of the invention, is made by way of example and that various other embodiments are possible without departing from the subject matter coming within the scope of the following claims, which subject matter is regarded as the invention.

I claim:

1. An intermittent flow irrigation method for advancing irrigation water down a furrow, the method comprising the steps of:

advancing irrigation water down a portion of the length of the furrow using an on/off irrigation cycle comprising the steps of:

supplying a continuous flow of irrigation water into a head end of the furrow during a first predetermined time period such that the irrigation water advances down a portion of the length of the furrow; and refraining from supplying irrigation water into the furrow during a second predetermined time period, thereby allowing the irrigation water supplied to the furrow during the first predetermined time period to seep into the furrow; and repeating the on/off irrigation cycle so as to advance the irrigation water further down the length of the furrow, the on/off irrigation cycle being repeated until the water extends to substantially near a bottom end of the furrow.

2. An intermittent flow irrigation method as defined in claim 1 wherein irrigation water is distributed to a plurality of furrows.

3. An intermittent flow irrigation method as defined in claim 2:

wherein the furrows are divided into a first set of furrows and a second set of furrows; and wherein the on/off irrigation cycle for the first set of furrows is staggered with respect to the on/off irrigation cycle for the second set of furrows such that while irrigation water is being supplied into the first set of furrows, no irrigation water is being supplied into the second set of furrows, and such that while no irrigation water is being supplied into the first set of furrows, irrigation water is being supplied into the second set of furrows.

4. An intermittent flow irrigation method as defined in claim 2:

wherein the furrows are divided into three or more sets of furrows; and wherein the on/off irrigation cycle for each set of furrows is staggered with respect to the on/off irrigation cycles for the other sets of furrows.

5. An intermittent flow irrigation method as defined in claim 1 wherein the first predetermined time period is substantially equivalent to the second predetermined time period.

6. An intermittent flow irrigation method for distributing irrigation water relatively evenly along a furrow, the method comprising the steps of:

advancing irrigation water to substantially near the end of the furrow during an advance phase and allowing the irrigation water so advanced to seep into the furrow;

supplying irrigation water to the furrow during an infiltration phase after the advance phase, the infiltration phase comprising the steps of the following on/off cycle:

supplying a continuous flow of irrigation water into a head end of the furrow for a first predetermined time period which is shorter than the period of time during which irrigation water was advanced down the furrow during the advance phase; and subsequently refraining from supplying irrigation water into the furrow during a second predetermined time period which is shorter than the period of time during which irrigation water was advanced down the furrow during the advance phase; and repeating the on/off cycle of the infiltration phase a predetermined number of times in order to supply a predetermined amount of irrigation water to the furrow.

7. An intermittent flow irrigation method as defined in claim 6:

wherein the advance phase comprises the steps of the following on/off cycle:

supplying a continuous flow of irrigation water into the head end of the furrow during a period of time which is longer than the first and second predetermined time periods such that the irrigation water advances down a portion of the length of the furrow; and subsequently refraining from supplying irrigation water into the furrow during a period of time which is longer than the first and second predetermined time periods, thereby allowing the irrigation water supplied to the furrow to seep into the furrow; and wherein the on/off cycle of the advance phase is repeated so as to advance the irrigation water further down the length of the furrow, the on/off cycle of the advance phase being repeated until the water extends to substantially near a bottom end of the furrow.

8. An intermittend flow irrigation method as defined in claim 6 wherein irrigation water is distributed to a plurality of furrows.

9. An intermittent flow irrigation method as defined in claim 8:

wherein the furrows are divided into a first set of furrows and a second set of furrows; and wherein the on/off cycle of the infiltration phase for the first set of furrows is staggered with respect to the on/off cycle of the infiltration phase for the second set of furrows such that while irrigation water is being supplied into the first set of furrows, no irrigation water is being supplied into the second set of furrows, and such that while no irrigation water is being supplied into the first set of furrows, irrigation water is being supplied into the second set of furrows.

10. An intermittent flow irrigation method as defined in claim 8:

wherein the furrows are divided into three or more sets of furrows; and wherein the on/off cycle of the infiltration phase for each set of furrows is staggered with respect to the on/off cycles of the infiltration phase for the other sets of furrows.

11. An intermittent flow irrigation method as defined in claim 8 further comprising the step of providing each furrow with valving means for selectively allowing or precluding the flow of irrigation water into the head end of the furrow.

12. An intermittent flow irrigation method as defined in claim 6 wherein the first predetermined time period is substantially equivalent to the second predetermined time period.

13. An intermittent flow irrigation method for distributing irrigation water relatively evenly along a plurality of furrows divided into a first set of furrows and a second set of furrows, the method comprising the steps of:

advancing irrigation water down a portion of the length of the first and second sets of furrows during an advance phase using an on/off cycle comprising the steps of:

supplying a continuous flow of irrigation water into head ends of the first set of furrows during a first predetermined time period such that the irrigation water advances down a portion of the length of the first set of furrows;

refraining from supplying irrigation water into the second set of furrows during the first predetermined time period;

supplying a continuous flow of irrigation water into head ends of the second set of furrows during a second predetermined time period such that the irrigation water advances down a portion of the length of the second set of furrows; and refraining from supplying irrigation water into the first set of furrows during the second predetermined time period;

repeating the on/off cycle of the advance phase so as to advance the irrigation water further down the length of the first and second sets of furrows, the irrigation water seeping into the first and second sets of furrows during the refraining steps of the on/off cycle of the advance phase, the on/off cycle being repeated until the water in each furrow extends to substantially near a bottom end of the furrow;

supplying irrigation water to the first and second sets of furrows during an infiltration phase after the advance phase, the infiltration phase comprising the steps of the following on/off cycle:

suppying a continuous flow of irrigation water into the head ends of the first set of furrows during a third predetermined time period which is shorter than the first and second predetermined time periods;

refraining from supplying irrigation water into the second set of furrows during the third predetermined time period;

supplying a continuous flow of irrigation water into the head ends of the second set of furrows during a fourth predetermined time period which is shorter than the first and second predetermined time periods; and refraining from supplying irrigation water into the first set of furrows during the fourth predetermined time period; and repeating the on/off cycle of the infiltration phase a predetermined number of times in order to supply a predetermined amount of irrigation water to the first and second sets of furrows.

14. An intermittent flow irrigation method as defined in claim 13 wherein the first predetermined time period is substantially equivalent to the second predetermined time period and wherein the third predetermined time period is substantially equivalent to the fourth predetermined time period.

15. An intermittent flow irrigation method as defined in claim 14 further comprising the step of providing each furrow with valving means for selectively allowing or precluding the flow of irrigation water into the head end of the furrow.

* * * * *

UNITED STATES PATENT AND TRADEMARK OFFICE

CERTIFICATE OF CORRECTION

PATENT NO. : 4,577,802

DATED : March 25, 1986

INVENTOR(S) : Jack Keller et al.

It is certified that error appears in the above-identified patent and that said Letters Patent is hereby corrected as shown below:

Column 1, line 31, "to runoff" should be --to run off--
Column 1, line 33, "The run-off" should be --The runoff--
Column 1, line 42, "run-off" should be --runoff--
Column 2, line 53, "pipe line" should be --pipeline--
Column 6, line 9, "percentage cutbacks" should be --percentage of cutbacks--
Column 6, lines 9-10, "the the" should be --the--
Column 6, line 18, "percentage cutback" should be --percentage of cutback--
Column 6, lines 27-28, "with substantially" should be --with a substantially--
Column 6, line 45, "with substantially" should be --with a substantially--
Column 6, line 64, "opened," should be --opened;--

Signed and Sealed this

*Nineteenth* Day of *August 1986*

[SEAL]

*Attest:*

DONALD J. QUIGG

*Attesting Officer*

*Commissioner of Patents and Trademarks*